US006326880B1

(12) United States Patent
Tice

(10) Patent No.: US 6,326,880 B1
(45) Date of Patent: Dec. 4, 2001

(54) DETECTOR WITH CONTROL SWITCH

(75) Inventor: Lee D. Tice, Bartlett, IL (US)

(73) Assignee: Pittway Corporation, Chicago, IL (US)

( * ) Notice: Subject to any disclaimer, the term of this patent is extended or adjusted under 35 U.S.C. 154(b) by 0 days.

(21) Appl. No.: 09/163,792

(22) Filed: Sep. 30, 1998

(51) Int. Cl.[7] ..... G08B 13/02

(52) U.S. Cl. ..... 340/286.05; 340/517; 340/506; 340/514; 340/533; 340/538

(58) Field of Search ..... 340/506, 507, 340/286.05, 508, 514, 531, 533, 538

(56) References Cited

U.S. PATENT DOCUMENTS

| | | | |
|---|---|---|---|
| 4,083,037 | 4/1978 | Larson | 340/629 |
| 4,167,688 | 9/1979 | Burek et al. | 315/320 |
| 4,176,346 | 11/1979 | Johnson et al. | 340/524 |
| 4,250,500 | 2/1981 | Schade | 340/628 |
| 4,380,760 | 4/1983 | Kornblit | 340/628 |
| 4,383,251 | 5/1983 | Perelli et al. | 340/527 |
| 4,567,477 | 1/1986 | Cormier | 340/644 |
| 4,827,244 | 5/1989 | Bellavia et al. | 340/514 |
| 5,093,651 | 3/1992 | Thomas | 340/628 |
| 5,121,101 | 6/1992 | Jakubowski et al. | 340/515 |
| 5,243,330 | 9/1993 | Thuillard | 340/629 |
| 5,442,336 | 8/1995 | Murphy et al. | 340/628 |
| 5,568,129 | 10/1996 | Sisselman et al. | 340/628 |
| 5,625,345 | 4/1997 | Stark et al. | 340/628 |
| 5,705,979 * | 1/1998 | Fierro et al. | 340/517 |
| 5,721,529 | 2/1998 | Warner et al. | 340/515 |

* cited by examiner

*Primary Examiner*—Daryl Pope
(74) *Attorney, Agent, or Firm*—Rockey, Milnamow & Katz, Ltd.

(57) ABSTRACT

An ambient condition detector incorporates a control switch which can be actuatable by one of a plurality of circumstances. In a response to an actuated switch, control circuitry of the detector selects at least one predetermined function or process to carry out. The control circuitry can include a programmed processor and a storage unit. A plurality of processes or functions can be stored in the storage unit. One or more of the processes can be selected for execution in response to signals received from the control switch. The switch can be closed in response to manual actuation, a magnetic field, or incident electromagnetic radiation such as RF signals or a beam of light.

39 Claims, 2 Drawing Sheets

FIG. 3
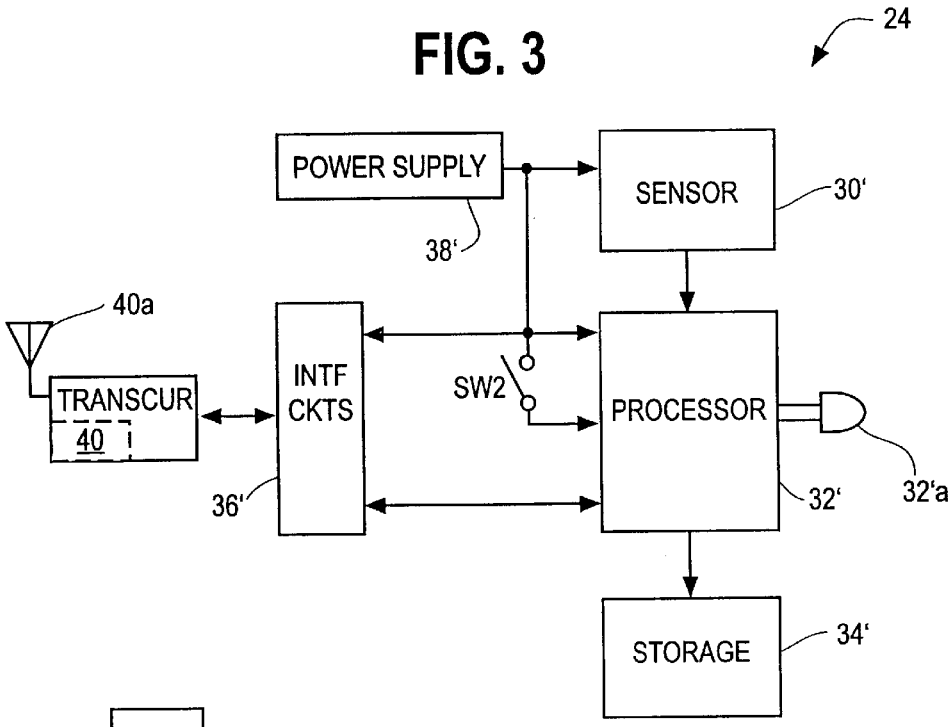
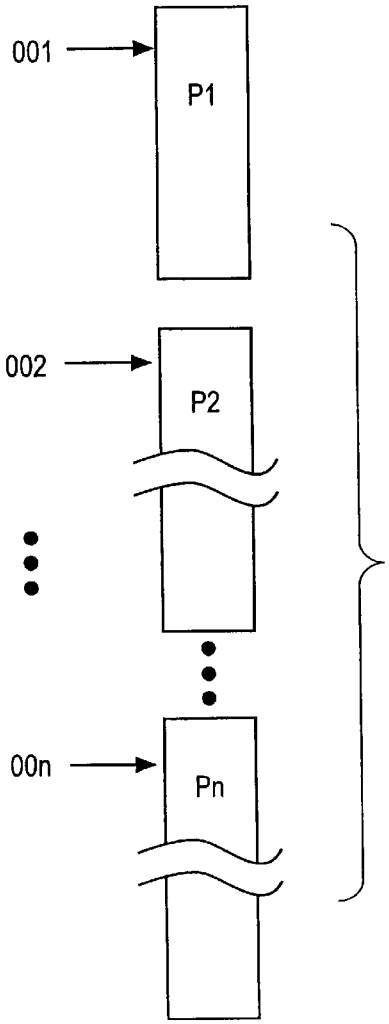
FIG. 4

DETECTOR WITH CONTROL SWITCH

FIELD OF THE INVENTION

The invention pertains to controllable electrical units. More particularly, the invention pertains to ambient condition detectors responsive to various control signals generated by external actions.

BACKGROUND OF THE INVENTION

Remotely activated test systems for use with ambient condition detectors have been disclosed in Bellavia et al U.S. Pat. No. 4,827,244, entitled Test Initiation Apparatus With Continuous or Pulse Input. Such systems have been used to remotely activate a switch to initiate a self-test of the respective detector or to temporarily silence a detector. Such systems, while useful, have been intended to carry out a predetermined unchangeable function.

It would be desirable to be able to reconfigure a selected process to be carried out by a detector in response to a predetermined input. Preferably such flexibility could be incorporated without substantially increasing the manufacturing cost or complexity of the respective detector.

SUMMARY OF THE INVENTION

An electrical unit incorporates control circuitry coupled to a control switch. The control switch defines a selected identifier, when closed, which could be detected by the control circuitry and used to identify a process to be executed. The identified process can be stored in a memory unit coupled to the control circuitry.

The contents of the memory unit can be loaded from a data stream received from a remote source. The received data stream can be stored in selected locations of the memory unit. A closure of a control switch can in turn cause the control circuitry to carry out the downloaded and stored process in the memory unit.

The control switch can be implemented as a normally open mechanical switch. The switch can be closed in response to manual operation. Alternately, a reed relay or switch could be used which could be closed or opened in response to an adjacent magnetic field. The switch can also be responsive to incident electromagnetic energy such as from a source of RF signals or a beam of incident light.

In one embodiment, closure of the switch can be used to select one of a plurality of prestored processes based on one or more existing conditions. For example, the state of various control signals of the control circuitry in combination with the switch closure can determine which process from the plurality is selected. In this way, different functions or different processes can be carried out depending on the circumstances.

In one aspect the unit can include an ambient condition sensor and interface circuitry for purposes of communicating with a remote control device. The control circuitry can be implemented with a local programmed processor. Process sequences to be executed can be downloaded to the processor from the control device.

The actuatable control switch can be used to cause different functions to be carried out when closed. These functions include:

1. initiating a self-test of some or all of the unit, such as an ambient condition sensor;
2. transmitting a predetermined message, previously programmed via the downloaded information;

3. initiating an indication of a parameter value such as sensitivity, or address or any other parameter specified via the downloaded information;
4. silencing the unit locally.

In yet another aspect, a plurality of functions can be downloaded to the unit. Activating or closing the switch for a time interval less than a preset amount can be used to select one member of the plurality of functions. Activating the switch for a longer time interval can be used to select another member of the plurality. Similarly, switch closures can be coded to generate a binary sequence over a predetermined period of time to specify yet another process or processes from the plurality.

In a further aspect, where the control circuitry has been implemented with a programmed processor, processes to be carried out or executed can be stored in non-volatile memory coupled to the processor. In response to a switch closure(s), the processor can access a predetermined register. The contents of the register can specify the process to be executed. The contents of the register, along with the members of the plurality of processes can be downloaded to the unit from a remote, common control device.

A plurality of units can be coupled by wireless or wired media to the control device. The control device can, in turn, download a plurality of functions, or processes, specifying identifiers to respective units. One or more sets of executable instructions, which define the various functions or processes, can also be downloaded to respective units.

Numerous other advantages and features of the present invention will become readily apparent from the following detailed description of the invention and the embodiments thereof, from the claims and from the accompanying drawings.

BRIEF DESCRIPTION OF THE DRAWINGS

FIG. 3 is a block diagram of another form of an electrical unit usable with the system of FIG. 1; and FIG. 4 illustrates a plurality of different supplemental processes executable by the units of FIG. 2 and FIG. 3.

DETAILED DESCRIPTION OF THE PREFERRED EMBODIMENTS

Figure 1:
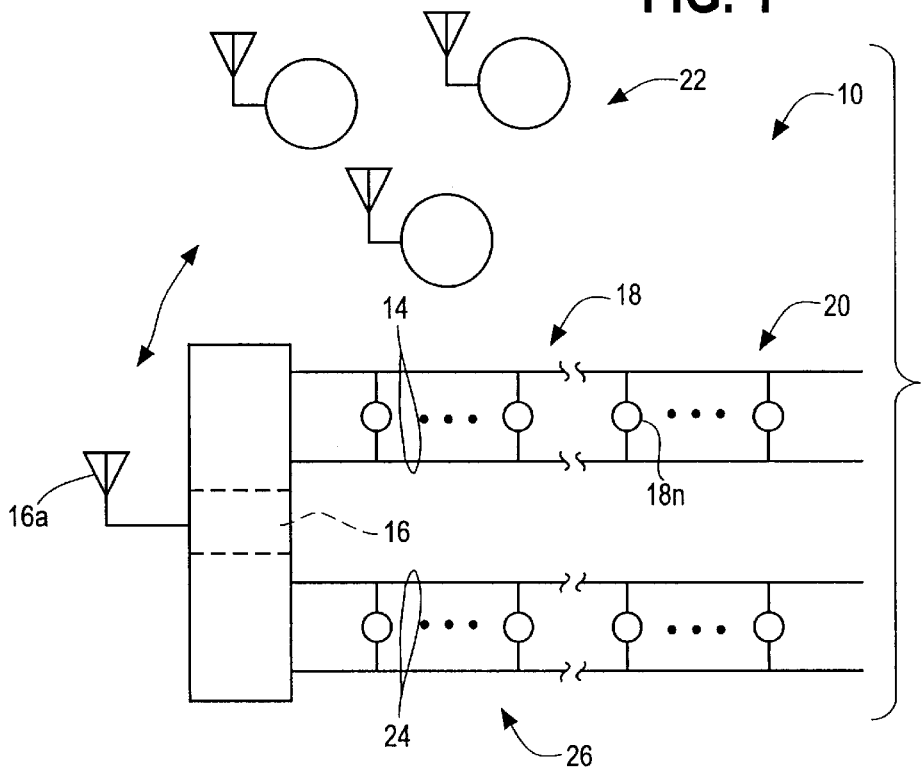
FIG. 1 is a block diagram of a system in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a system 10 which can be used for monitoring a plurality of conditions in one or more regions to be supervised. The system 10 includes a common control device 12 which could be implemented as one or more interconnected programmed processors and associated, prestored instructions.

The device 12 includes an interface for coupling, for example, to a communications medium 14, illustrated in FIG. 1 for exemplary purposes as an optical or electrical cable. Alternately, the system 10 can communicate wirelessly, such as by RF or infrared, via transceiver 16, illustrated in phantom in FIG. 1, and antenna 16*a*.

Coupled to medium 14 is a plurality of ambient condition detectors 18 and a plurality of control or function units 20. It will be understood that the relative arrangement of the members of the pluralities 18 and 20 relative to the medium 14 is not a limitation of the present invention.

The members of the plurality 18 can include intrusion sensors, position sensors, gas sensors, fire sensors such as smoke sensors, thermal sensors or the like, and gas sensors, all without limitation. The members of the plurality 20 can include solenoid actuated control or function implementing units, display devices, printers or the like.

Where system 10 incorporates a wireless communications medium, a plurality 22 of wireless units could be in bidirectional communication with transceiver 16. The plurality 22 can include, without limitation, ambient condition detectors, as noted above as well as control or function implementation devices without limitation.

Also coupled to the control unit 12 via a medium 24, illustrated for example as a pair of electrical cables, is a plurality 26 of output devices. These could include audible or visible output devices without limitation, speech output devices and the like. The devices 26 are intended to broadcast a human discernable message, which might indicate alarm condition, in one or more predetermined regions.

Figure 2:
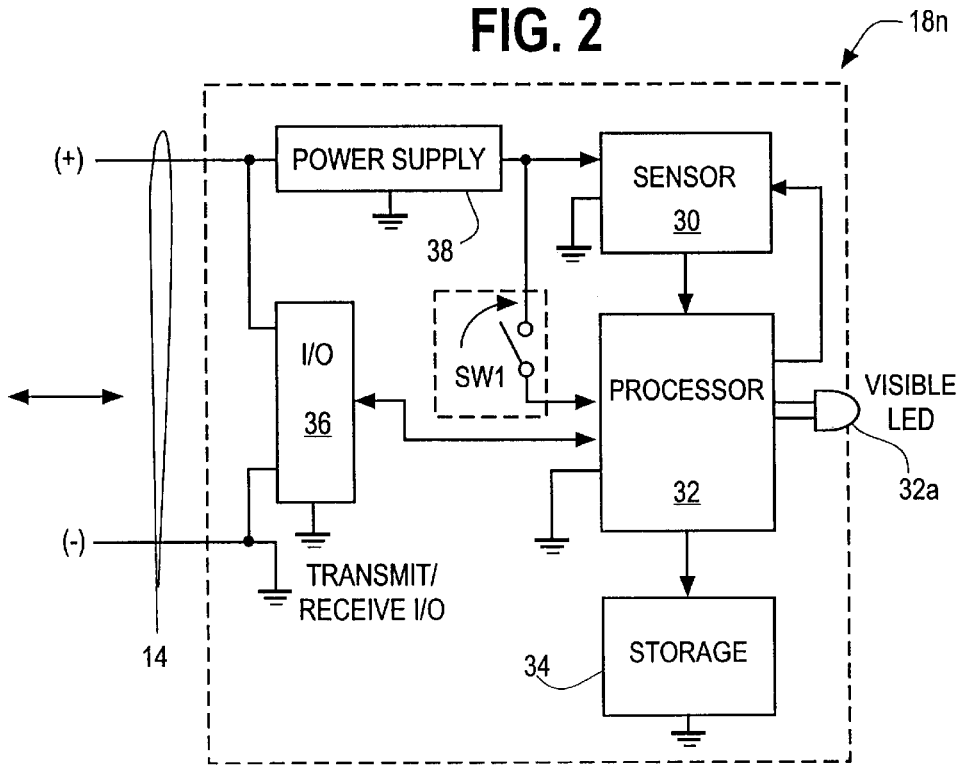
FIG. 2 is a block diagram of one form of an electrical unit usable with the system of FIG. 1.

FIG. 2 illustrates an exemplary member 18*n* of the plurality 18. The member 18*n*, an ambient condition detector includes a sensor 30, which could include without limitation ambient condition sensors such as smoke sensors, thermal sensors, gas sensors, position sensors, movement sensors and the like.

Sensor 30 is in turn coupled to control element 32 which could be implemented as a programmed processor. A visual output device 32*a*, such as a light emitting diode, is coupled to processor 32. Output device 32*a* can be energized by processor 32 to provide visual feedback to an individual in the vicinity of unit 18*n*. Audible output devices, coupled to processor 32, could also be used to provide local feedback.

Processor 32 is in bidirectional communication with storage element 34. The element 34 could include read only as well as volatile and non-volatile read/write memory cells. Storage unit 34 could be used to store control programs to be executed by the detector 18*n* as well as to store operating constants or other information.

Storage unit 34 can include a primary control program to be executed by processor 32. For example, the primary program, in combination with sensor 30, implement an ambient condition detector.

Input/output circuitry 36 coupled to control circuitry 32 provides bidirectional communication via medium 14 with other members of the plurality 18 as well as common control device 12. The unit 18*n* can be energized by a local power supply 38 which receives electrical energy via the medium 14. Control programs or supplemental processors can be downloaded to unit 18*n* as discussed below.

The unit 18*n* also includes a switch SW1 coupled to control circuitry 32. The switch SW1 can be closed by an external event such as an adjacent magnetic field, incident radiant energy such as infrared or visible light, incident RF signals or mechanical movement of a switch lever.

Closure of the switch SW1 couples a voltage from supply 38 to control circuitry 32. In response, control circuitry 32 could, on an interrupt or poling basis, read the contents of a register which could be stored within the control circuitry 32 or could correspond to a location in storage unit 34. The contents of the register that has been read could be an address or a pointer to one of a plurality of supplemental processes to be carried out by the unit 18*n* in response to closure switch SW1.

As those of skill in the art will understand, switch SW1 could be implemented as a bit pattern in a memory location. In this embodiment, a bit pattern could be downloaded from another processor in the system. The downloaded pattern could be read on an interrupt driven basis or in response to another condition. The pattern can specify a function defining memory location or sequence. Alternatively, it could correspond to an entry into a function specifying or defining table.

FIG. 4 illustrates a plurality of supplemental processes P1, P2 . . . Pn which can be preloaded into storage unit 34. Processes P1, P2 . . . Pn which could include sequences of executable instructions could be downloaded from control device 12 or from other members of the pluralities 18 or 20.

Closure of the switch SW1 in turn results in control circuitry of processor 32 extracting an address or a pointer from a register. For example, address 001, 002, 00n correspond to an entry point for each of the respective processes P1, P2 . . . Pn. The process which is identified or pointed to is then executed by processor or control circuitry 32.

Where the unit 18*n* corresponds to an ambient condition detector, some of the supplemental processes or functions which can be defined include:

1. initiating self-test of the respective sensor 30;
2. transmitting a pre-stored message which had been previously received as downloaded information from control device 12;
3. communicating an indication of sensitivity address or any other parameter as defined through previously downloaded information;
4. silencing the device locally if it has for some reason gone into an alarm state.

Additional and expanded examples of functions or supplemental processes which can be carried out by processor or control circuitry 32 in response to closure of SW1 include:

| Identifier | Function |
|---|---|
| 0000 0001 | Initiate a self-test of the sensor and transmit a normal signal if OK |
| 0000 0010 | Initiate a self-test of the sensor and transmit an alarm message if OK |
| 0000 0100 | Transmit a "walk test" message |
| 0000 1000 | Transmit a "guard report" message |
| 0001 0000 | Blink the visible LED (or other method) to indicate the sensitivity value |
| 0010 0000 | Blink the visible LED(or other method) to indicate the address |
| 0100 0000 | Transmit the address of the device |
| 1000 0000 | Transmit the serial number of the device. |

Additional codes can be used for more functions. A message to download information into the device from the control unit in the system may have the following structure:

| BYTE | Description |
|---|---|
| 1 | Priority for communication access |
| 2 | Download style message defined |
| 3 | Address of unit to receive message |

-continued

| BYTE | Description |
|---|---|
| 4 | Register location to download information into |
| 5 | Information/function or process (code) to be downloaded |
| 6 | Check sum of message for error detection |

The code may be changed at any time by the control device 12 in anticipation of local operation of the switch SW1. The initial switch function to be downloaded corresponds to identifier 0000 0001 so that any activation of the switch SW1 will not cause alarms within the alarm system 10. If the fire alarm system is to be tested to make sure that the operation is proper, then the switch function is downloaded as 0000 0010 which will cause the unit 18*n* to transmit an alarm message to the system 10. If it is required to check the address of installed units in actual locations without removing the respective unit, the switch function is downloaded as 0010 0000 and the address presented as pulses on visible LED 32*a* can be observed.

The switch SW1 may be a mechanical switch (close contact or open contact by manual operation), reed relay or switch (close contact or open contact by magnetic field), or an electronic switch (photo receiver operated by light or electromagnetic energy). Other means of implementing a switch are within the spirit and scope of the present invention. Additional circuitry may also be used between the switch and the microcontroller to provide appropriate signals for the microcontroller.

It will also be understood that switch SW1 can be closed and opened to form a command pattern to identify one of a plurality of supplemental processes or functions to be executed. For example, control circuitry 32 could recognize that the switch SW1 has been closed for less than a predetermined period of time, for example, two to three seconds or longer than that time period. In response to a shorter or longer closure, one or another register can be accessed, each of which could contain an identifier or a pointer to one of the supplemental processes or functions of FIG. 4.

Alternately, control circuitry 32 could recognize a coded binary sequence of ones and zeros, corresponding to switch closures and openings in some predefined period of time. This binary combination could in turn be used to define a register or a pointer specifying one of the plurality of supplemental processes or functions. Other variations are also possible. For example, two switches can be provided which could be opened and closed independently for the purpose of identifying one or more of the supplemental processes to be executed.

It will also be understood that while the switch SW1 has been illustrated in FIG. 2 as part of an ambient condition detector 18*n* that this is not a limitation of the present invention. The switch SW1 could, for example, be incorporated into one of the control units or modules of the plurality 20. In such an instance, the supplemental processes or functions would be defined and structured in accordance with the purpose and capability of the respective member of the plurality 20.

FIG. 3 illustrates an exemplary member 22*i* of the plurality of wirelessly coupled units 22. The unit 22*i* includes an ambient condition sensor 30' which is in turn coupled to a local programmed processor or other control circuitry 32' of the type described above.

Storage unit 34' is in turn coupled to control circuitry 32' and can be used for the purpose of storing instructions, operating constants, and the like, as would be understood by those of skill in the art. Storage unit 34 can be downloaded with a primary control program and a plurality of supplemental processes or functions, FIG. 4.

A visual indicator such as a light emitting diode 32'*a* is also coupled to the processor 32'. Processor 32' in turn via interface circuitry 36' is in bidirectional communication with wireless transceiver 40 which could transmit and/or receive RF signals via antenna 40*a* to/from control device 12.

The unit 22*i* also includes closable switch SW2 similar to the switch SW1 previously described. The switch SW2 can be closed by an external event or code as described previously with respect to the unit 18*n*. This will in turn cause control circuitry or processor 32' to execute one of the plurality of supplemental processes or functions, as illustrated in FIG. 4.

It will also be understood that the members of the wirelessly coupled plurality 22 could include, in addition to ambient condition detectors, other types of control or function modules for locking or unlocking doors, energizing or de-energizing lights or other types of devices to be controlled.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A detector comprising:

a sensor;

a control element, coupled to the sensor;

a bi-state, device coupled to the control element, wherein the device, in response to a selected input, assumes one of a first and a second state and wherein at least one of the states identifies a selected, alterable, process to be carried out by the control element; and which includes storage elements and write circuitry coupled to the storage elements for writing a process, at least in part, thereinto.

2. A detector as in claim 1 wherein the device, when in at least one state, specifies at least one process which had previously been stored.

3. A detector as in claim 1 wherein the sensor comprises one of a smoke sensor, a thermal sensor and a gas sensor.

4. A detector as in claim 3 wherein the process is selected from a class which includes at least a self-test process, a message transmission process, a visual indication process and an audible indication process.

5. A detector as in claim 3 which includes circuitry for generating the selected input in response to one of a received radiant energy signal, a sonic signal, a received binary command and a manual input.

6. A detector as in claim 1 wherein the control element includes a programmed processor and a plurality of prestored control instructions.

7. A detector comprising:

a sensor;

a control element, coupled to the sensor;

a bi-state device, coupled to the control element, wherein the device, in response to a selected input, assumes one of a first and a second state and wherein at least one of the states identifies a selected, alterable, process to be carried out by the control element;

which includes circuitry for detecting the presence of a coded at least one state; and wherein the circuitry for detecting the presence of a coded at least one state responds to at least one time duration of the at least one state.

8. A method of implementing a switch in a communication system wherein a plurality of devices is coupled to the system, the method comprising remotely electrically specifying the function of the switch using transmitted messages where some of the functions that can be specified cause the respective device to carry out one of, transmitting an alarm message, transmitting a walk test message, transmitting a monitoring station message, carrying out a self-test, and providing a sensitivity indication.

9. A method of implementing a switch in a communication system wherein a plurality of devices is coupled to the system, the method comprising remotely specifying the function of the switch using transmitted messages;

where the switch is an electronic switch; and where the switch is actuated by generating a light signal using an external device.

10. A method as in claim 9 where the light signal is generated from a flashlight directed at the device.

11. A method as in claim 9 where the light signal is modulated to transmit the message to the device.

12. A process of controlling an electrical unit comprising:

establishing a normal operating sequence for the unit;

establishing a plurality of supplemental steps defining a process to be carried out by the unit in response to the presence of an exterior input;

providing the supplemental steps at the unit;

electrically storing the steps at the unit;

detecting the presence of the exterior input, and in response thereto carrying out the supplemental steps at the unit.

13. A process of controlling an electrical unit comprising:

establishing a normal operating sequence for the unit;

establishing a plurality of supplemental steps defining a process to be carried out by the unit in response to the presence of an exterior input;

providing the supplemental steps at the unit;

detecting the presence of the exterior input, and in response thereto carrying out the supplemental steps at the unit;

which includes establishing at the unit at least first and second, different, pluralities of supplemental steps to be carried out in response to the presence of respective, distinguishable exterior inputs; and detecting the presence of an exterior input, correlating that input with a respective plurality of supplemental steps, and in response thereto carrying out the respective supplemental steps.

14. A process as in claim 13 wherein exterior inputs are distinguished from one another by their respective durations.

15. A process as in claim 13 wherein exterior inputs are distinguished from one another by their respective frequencies.

16. A process of controlling an electrical unit comprising:

establishing a normal operating sequence for the unit;

establishing a plurality of supplemental steps defining a process to be carried out by the unit in response to the presence of an exterior input;

providing the supplemental steps at the unit;

detecting the presence of the exterior input, and in response thereto carrying out the supplemental steps at the unit; and which includes sensing a predetermined ambient condition at the unit.

17. A process as in claim 16 wherein the sensing step includes sensing a condition indicative of a fire.

18. A process of controlling an electrical unit comprising:

establishing a normal operating sequence for the unit;

establishing a plurality of supplemental steps defining a process to be carried out by the unit in response to the presence of an exterior input;

providing the supplemental steps at the unit;

detecting the presence of the exterior input, and in response thereto carrying out the supplemental steps at the unit; and comprising storing the supplemental steps in binary form at the unit.

19. A method of controlling a programmable electrical unit comprising:

providing a primary control program and loading it into the unit for execution;

initiating execution of the primary control program;

providing at least one additional control program in executable form and storing it at the unit;

sensing the presence of an ambient condition associated with initiating an additional control program, and in response thereto initiating execution of a selected additional control program; and continuing execution of the primary control program.

20. A method of controlling a programmable electrical unit comprising:

providing a primary control program and loading it into the unit for execution;

initiating execution of the primary control program;

providing at least one additional control program and storing it at the unit;

sensing the presence of an ambient condition associated with initiating an additional control program, and in response thereto initiating execution of a selected additional control program;

continuing execution of the primary control program;

wherein at least two different additional control programs are loaded into the control unit and sensing the presence of at least two distinguishable ambient conditions wherein each is associated with a respective one of the additional control programs and in response thereto initiating execution of the respective control program.

21. A method of controlling a programmable electrical unit comprising:

providing a primary control program and loading it into the unit for execution;

initiating execution of the primary control program;

providing at least one additional control program and storing it at the unit;

sensing the presence of an ambient condition associated with initiating an additional control program, and in response thereto initiating execution of a selected additional control program;

continuing execution of the primary control program;

wherein the unit includes a fire sensor and the primary control program interacts with the fire sensor and wherein the ambient condition corresponds to one of a magnetic field, a beam of incident radiant energy and an RF signal.

22. A method of controlling a programmable electrical unit comprising:

providing a primary control program and loading it into the unit for execution;

initiating execution of the primary control program;

providing at least one additional control program and storing it at the unit;

sensing the presence of an ambient condition associated with initiating an additional control program, and in response thereto initiating execution of a selected additional control program;

continuing execution of the primary control program;

which includes providing a first identifier to define the additional control program to be executed and in response to the sensed presence of the ambient condition, initiating execution of the additional control program specified by the identifier.

23. A method as in claim 22 including providing a second identifier to replace the first identifier and thereby specify a different additional control program.

24. A method as in claim 23 wherein the additional control program is selected from a class which includes a self-test program, a status message generation program and a parameter value readout program.

25. An ambient condition detector comprising:

an ambient condition sensor;

a control circuit coupled to the sensor;

a storage element coupled to the control circuit;

and a multi-state element coupled to the control circuit wherein the element, in one state specifies an identifier of a function, to be executed wherein the identifier is electrically alterable thereby altering the function prestored in the storage element.

26. An ambient condition detector comprising:

an ambient condition sensor;

a control circuit coupled to the sensor;

a storage element coupled to the control circuit;

and a multi-state element coupled to the control circuit wherein the element, in one state specifies an identifier of a function, to be executed wherein the identifier is alterable thereby altering the function; and wherein the element has less than eight discernable states and wherein each state specifies a function to be executed.

27. A detector as in claim 26 wherein the element comprises a two-state switch.

28. A fire detector comprising:

a fire sensor;

a programmable processor coupled to the sensor;

a storage element coupled to the processor wherein the storage element includes a plurality of executable processes; and a multi-state element coupled to the programmable processor wherein the element, in one state specifies an identifier of a process included in the storage element, to be executed wherein the identifier is electrically alterable thereby altering the specified process.

29. A fire detector comprising:

a fire sensor;

a programmable processor coupled to the sensor;

a storage element coupled to the processor wherein the storage element includes a plurality of executable processes;

a multi-state element coupled to the programmable processor wherein the element, in one state specifies an identifier of a process included in the storage element, to be executed wherein the identifier is alterable thereby altering the specified process; and wherein the element has less than eight discernable states and wherein each state specifies a process to be executed.

30. A fire detector comprising:

a fire sensor;

a programmable processor coupled to the sensor;

a storage element coupled to the processor wherein the storage element includes a plurality of executable processes;

a multi-state element coupled to the programmable processor wherein the element, in one state specifies an identifier of a process included in the storage element, to be executed wherein the identifier is alterable thereby altering the specified process; and wherein the element comprises a two-state switch.

31. A detector comprising:

a sensor;

a control element, coupled to the sensor;

an input device having at last two different states, coupled to the control element, wherein the device, in response to a selected input, assumes one of at least a first and a second state and wherein at least one of the states identifies a selected, alterable, process to be carried out by the control element; and wherein the device, when in at least one state, identifies a software specified process which had previously been stored.

32. A detector as in claim 31 wherein the sensor comprises at least one of a smoke sensor, a thermal sensor and a gas sensor.

33. A detector as in claim 32 wherein the process is selected from a class which includes at least a self-test process, a message transmission process, a visual indication process and an audible indication process.

34. A detector as in claim 32 which includes circuitry for generating the selected input in response to one of a received radiant energy signal, a sonic signal, a received binary command and a manual input.

35. An ambient condition detector comprising:

an ambient condition sensor;

a control circuit coupled to the sensor;

a storage element coupled to the control circuit;

and a multi-state input element coupled to the control circuit wherein the element, in one state specifies an identifier of a function, to be executed wherein the identifier is alterable thereby altering the function; and wherein the element responds to a local stimulus, has less than eight discernable states and wherein each state specifies a function to be executed.

36. A detector comprising:

a receiver circuit for receiving signals;

a processing circuit incorporating at least two selectable executable processes wherein at least one of the selectable executable processes is selected in response to receipt of one of at least two different respective signals;

a switch incorporated in the detector and coupled to the processing circuit wherein activating the switch causes the processing circuitry to execute the selected executable process; and wherein the switch can activate different executable processes in response to the received respective signal.

37. A method of implementing a switch in a device in a system which includes a plurality of coupled devices, the method comprising:

receiving a control signal at a device that causes the device to select an executable process from a group of selectable executable processes;

assigning the selected executable process as the function of a switch; and executing the selected executable process when the switch is activated wherein the switch can have different functions dependent upon the received control signal.

38. A detector comprising:

a sensor;

a control element, coupled to the sensor;

a bi-state switch coupled to provide an input to the control element, wherein the device, in response to a selected input, assumes one of a first and a second state and wherein at least one of the states identifies a selected electrically alterable, process to be carried out by the control element and a common housing for the sensor, the control element and the switch.

39. A detector comprising:

a sensor;

a control element, coupled to the sensor;

a control switch coupled in a common housing to provide an input to the control element, wherein the switch in response to a selected input, assumes one of a first and a second state and wherein at least one of the states identifies a selected, alterable, process to be carried out by the control element; and wherein the sensor comprises a fire sensor.

* * * * *